US005413299A

United States Patent [19]

Holtsch

[11] Patent Number: 5,413,299

[45] Date of Patent: May 9, 1995

[54] HOLDING DEVICE FOR CONTAINERS WITH TISSUES AND THE LIKE

[75] Inventor: Peter Holtsch, Wingsbach, Germany

[73] Assignee: Holtsch Metallwarenherstellung, Taunusstein, Germany

[21] Appl. No.: 289,760

[22] Filed: Aug. 12, 1994

[51] Int. Cl.[6] ..... A47G 29/00

[52] U.S. Cl. ..... 248/313; 248/310; 248/905; 248/316.1; 248/316.5

[58] Field of Search ..... 248/313, 905, 310, 309.1, 248/316.4, 316.1, 231.4, 316.5, 316.8; 221/45, 46

[56] References Cited

U.S. PATENT DOCUMENTS

| | | | |
|---|---|---|---|
| 2,958,496 | 11/1960 | Johnson | 248/313 X |
| 2,964,282 | 12/1960 | Johnson | 248/905 X |
| 3,229,844 | 1/1966 | Simon | 248/905 X |
| 3,733,044 | 5/1973 | Rabner | 248/313 |
| 3,902,932 | 9/1975 | Gdanski et al. | 248/905 X |
| 5,145,139 | 9/1992 | Holtsch | 248/313 |

*Primary Examiner*—Karen J. Chotkowski
*Attorney, Agent, or Firm*—Michael J. Striker

[57] ABSTRACT

A holding device for holding containers has a housing, an insert movable relative to the housing between a proximal position in which the container can be clamped between the insert and the housing and a distal position in which the insert is moved away from the housing so that the container can be removed from the device and a new container can be placed between the insert and the housing, and elements for engaging the container when it is located between the insert and the housing so as to reliably hold it in the device. The engaging elements include at least one engaging projection which is elastically urged to a position in which it is hidden in one of the insert and the housing when there is no container between the insert and the housing and which is displaced outwardly of the at least one of the insert and the housing to an extended position when the container is inserted between the insert and the housing and applies a pressure to the engaging elements.

6 Claims, 7 Drawing Sheets

FIG. 5
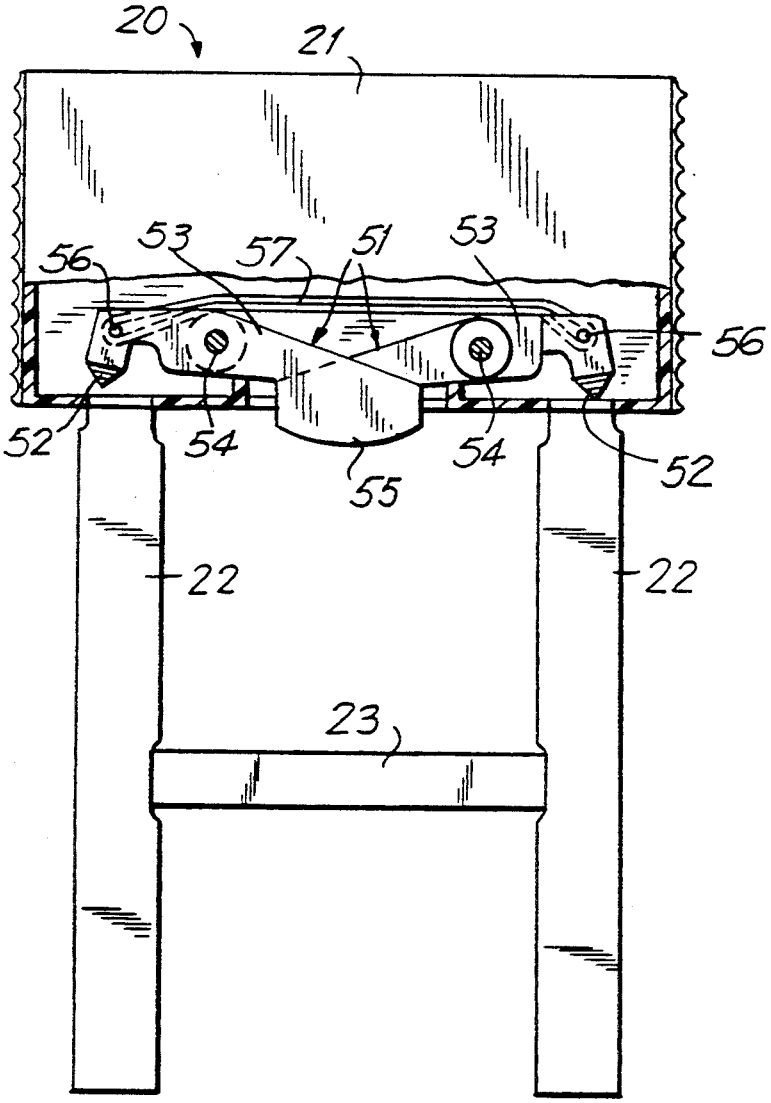
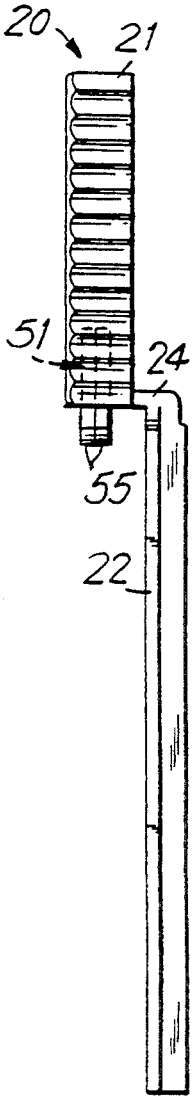
FIG. 6
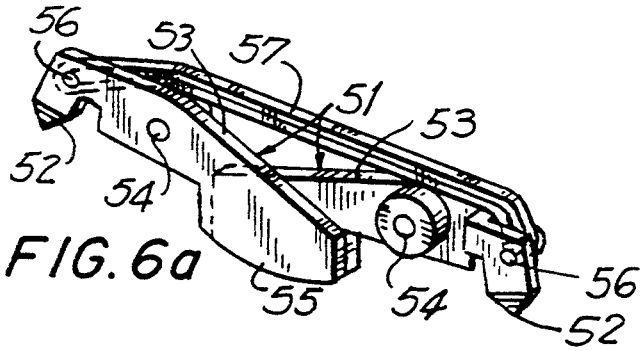
FIG. 6a

FIG.10
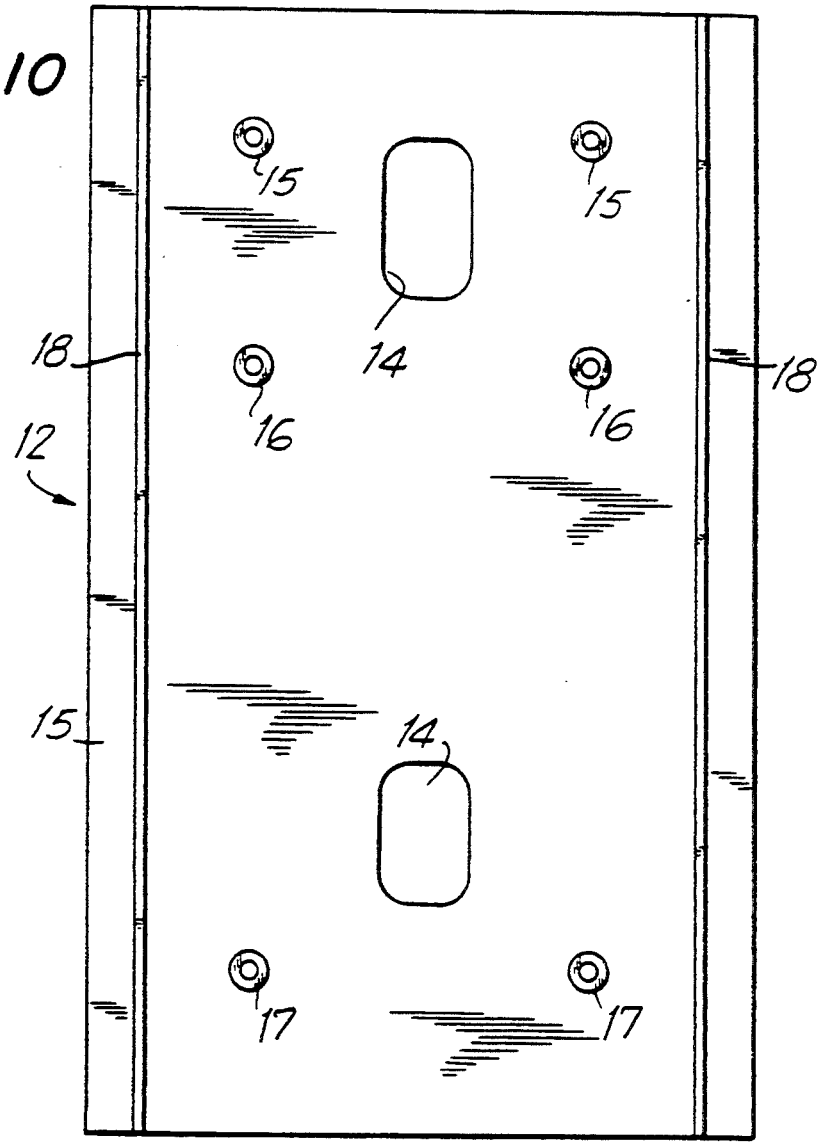
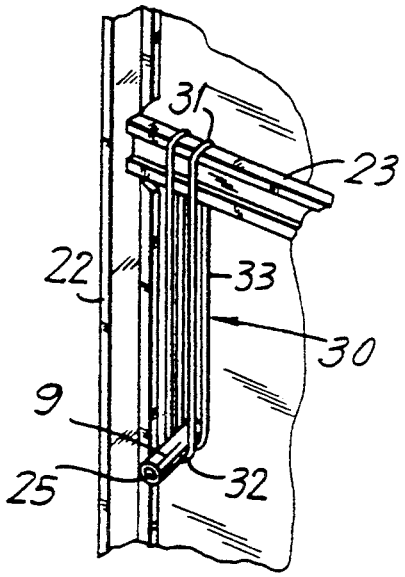
FIG. 11

HOLDING DEVICE FOR CONTAINERS WITH TISSUES AND THE LIKE

BACKGROUND OF THE INVENTION

The present invention relates generally to holding devices for holding containers which accommodate tissues and the like.

Holding devices of the above mentioned general type are known in the art. One of such holding devices is disclosed, for example in my U.S. Pat. No. 5,145,139. The holding device disclosed in this reference has a housing with a pin, an insert movable relative to the housing between a proximal position in which the container can be clamped between the insert and the housing and a distal position in which the insert is moved away from the housing so that the container can be removed from the device and the new container can be placed between the insert and the housing, and means for elastically urging the insert toward the housing to said proximal position. The insert can be moved away of the housing toward the distal position by a user with overcoming a resistance of the elastic means, and then the insert is moved back under the action of the elastic means. In the device disclosed in the above mentioned patent, there are engaging elements which engage in the container to firmly hold it in place. The engaging elements are formed as tooth-like projections. The holding device of the above mentioned general type performs its intended function. However, the tooth-like projections have certain disadvantages. During displacement of the insert toward the housing under the action of the elastic means, the tooth-like projections can in some cases hurt a user, and therefore it is desirable to modify the elements which engage in the container for holding them. If however the tooth-like projections are made dull so as to prevent any injury to a user, they will not penetrate into the material of the container and will not firmly hold it.

SUMMARY OF THE INVENTION

Accordingly, it is an object of the present invention to provide a holding device of the above mentioned general type, which eliminates the disadvantages of the prior art.

In keeping with these objects and with others which will become apparent hereinafter, one feature of the present invention resides, briefly stated, in a holding device for holding containers, comprising a housing, an insert movable relative to said housing between a proximal position in which the container can be clamped between said insert and said housing and a distal position in which said insert is moved away from said housing so that the container can be removed from the device and a new container can be placed between said insert and said housing, means for elastically urging said insert toward said housing to said proximal position, so that said insert can be moved away from said housing toward said distal position by overcoming a resistance of said elastic means, and means for additionally engaging the container and including at least one projection provided in at least one of said insert and said housing and movable between a first position in which it is hidden in said at least one of said insert and said housing when said insert is in said proximal position and there is no container between said insert and said housing and movable to an extended position under the action of a container inserted between said insert and said housing when said insert is in said proximal position.

When the holding device is designed in accordance with the present invention, it eliminates the disadvantages of the prior art and provides for highly advantageous results. In a normal position when there is no container between the insert and the housing, the engaging projection is hidden either in the insert or in the housing. However, when a container is inserted between the insert and the housing, the engaging projection is forcibly displaced to its extended position in which it extends outwardly beyond the insert and the housing and engages into the material of the container to firmly hold the latter. Thus, it is no longer possible that the engaging projection injures a user and at the same time it reliably retains the container between the insert and the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 5 and 6 are a front view and a side view of an insert part of the holding device in accordance with the present invention;

FIG. 6*a* is a perspective view of a mechanism for displacing engaging projections for engaging into the container to be clamped in the holding device;

FIG. 10 is a view from inside of the cover; and

FIG. 11 is a perspective view showing an elastic element for elastically connecting the parts of the holding device with one another.

DESCRIPTION OF THE PREFERRED EMBODIMENTS

Figure 1:
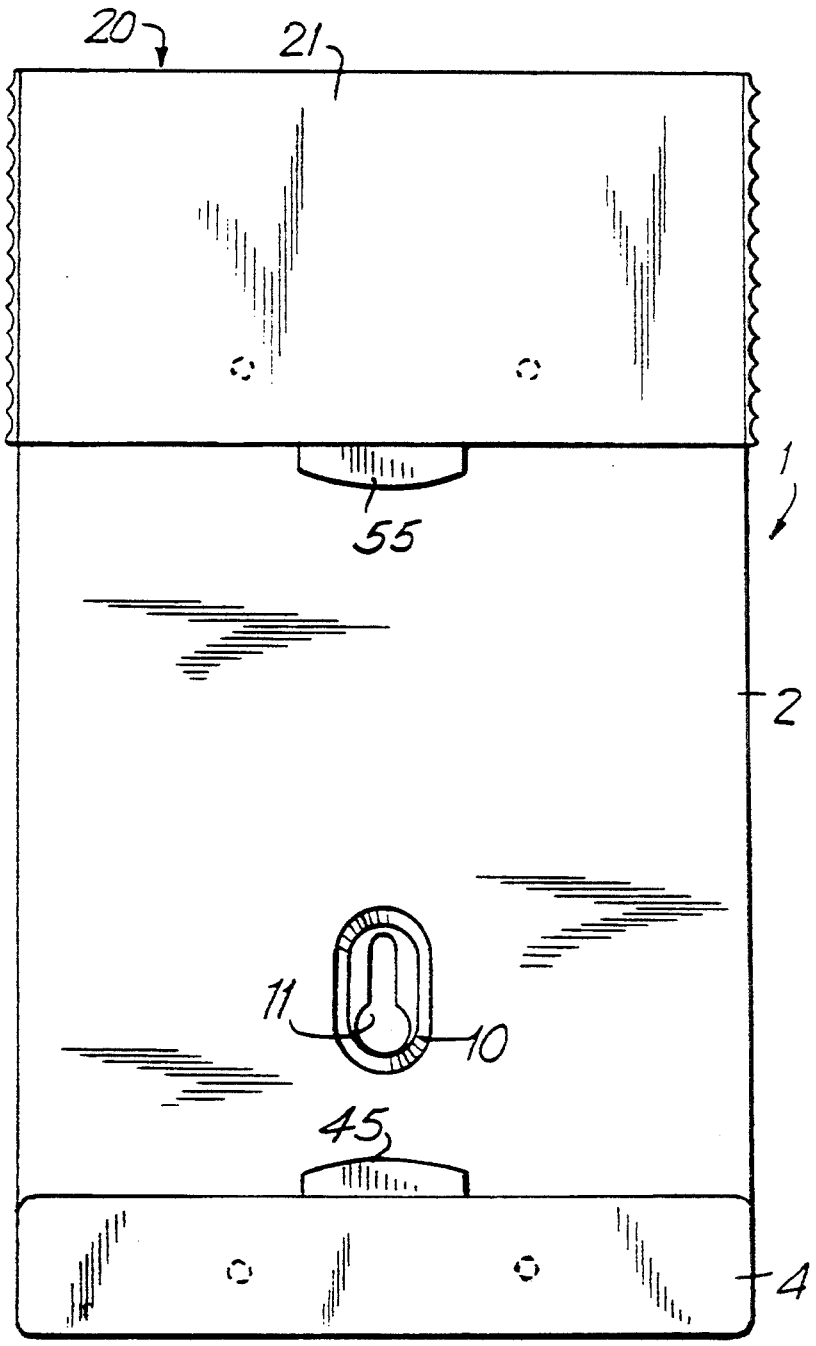
FIG. 1 is a front view of a holding device for holding containers for tissues in accordance with the present invention, in a proximal position of its part in which the container is clamped in the holding device.

A device for holding containers for tissues and the like has a housing composed generally of two parts. The first housing part is identified as a whole with reference numeral 1 and has a front wall 2 and an edge portion 3 extending along a contour of a front wall 2. On a lower end of the holding device the housing has a forwardly projecting flange 4. In the upper end of the holding device the housing has a slot 6 including two longitudinal slot portions connected by a transverse slot portion.

The first housing part also has three pairs of pins 7, 8 and 9 arranged so that the pins of each pair are located at opposite sides of the longitudinal axis of symmetry of the first housing part and the holding device. The first housing part also has two projections 10 each provided with a throughgoing opening 11.

The housing further includes a second housing part identified as a whole with reference numeral 12. The second housing part is formed as a cover. It has a wall 12' provided with two openings 14. The cover is also provided with adhesive strips 14' for adhesively attaching the holding device to a surface. In an assembled condition of the housing the openings 14 of the cover 12 are aligned with the openings 11 of the housing part 1. The cover also has three pairs of pins 15, 16 and 17 arranged in correspondence with the pins 7, 8 and 9 of the housing part 1. Finally, the cover is provided on its inner side with two guiding projections 18. In the assembled condition of the device, the projections 18 serve for guiding an insert part of the device as will be explained hereinbelow.

The holding device further has an insert which is identified as a whole with reference numeral 20. The insert has an upper portion 21, two elongated members 22 extending from the upper portion 21, and a transverse connecting portion 23 which connects the elongated members 22 with one another at locations space from the portion 21. The elongated members 22 are laterally offset from the portion 21 as can be seen from FIG. 6. In assembled condition of the holding device, a connecting piece 24 between the portion 21 and the elongated member 22 extends through a longitudinal portion of the slot 6 of the housing part 1, and the longitudinal members 22 are in sliding contact with the rear surface of the housing part 1. The pins 7, 8, 9 are provided with threaded blind holes 25, while the pins 15, 16, 17 are provided with throughgoing openings 26. In the assembled condition of the housing, not shown screws extend from the rear side of the cover through the openings 26 into the threaded holes 25 so as to hold the housing parts 1 and 12 together.

The insert 20 is connected with the housing and more particularly with the housing part 1 by elastic elements formed as rubber bands 30. The rubber bands 30 are located at opposite sides of the longitudinal axis of symmetry of the holding device.

Figure 7:
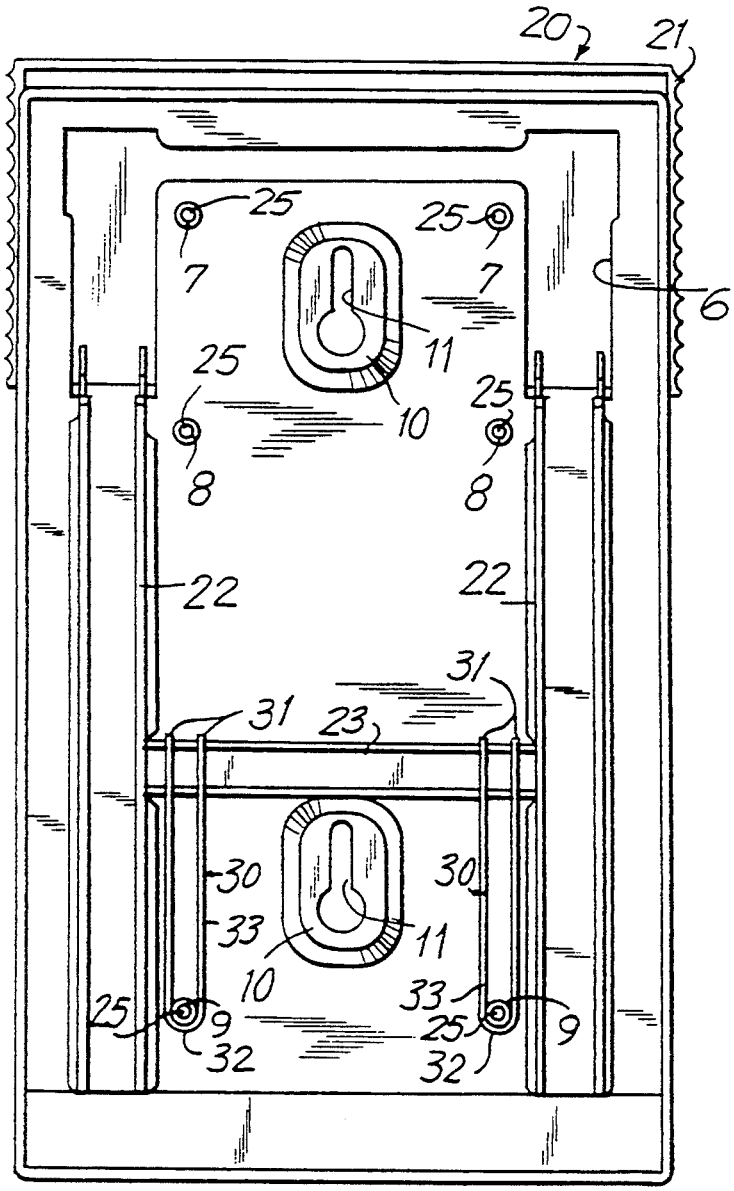
FIG. 7 is a rear view of the holding device in accordance with the present invention with a rear cover removed in the proximal position.
Figure 8:
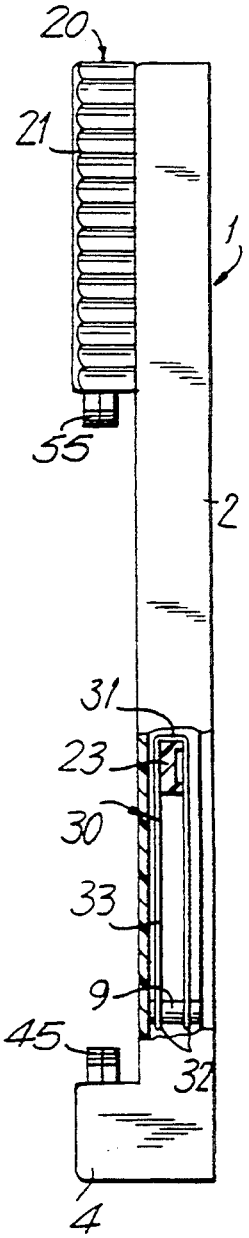
FIG. 8 is a side view showing a lower portion of the holding device in accordance with the present invention.
Figure 9:
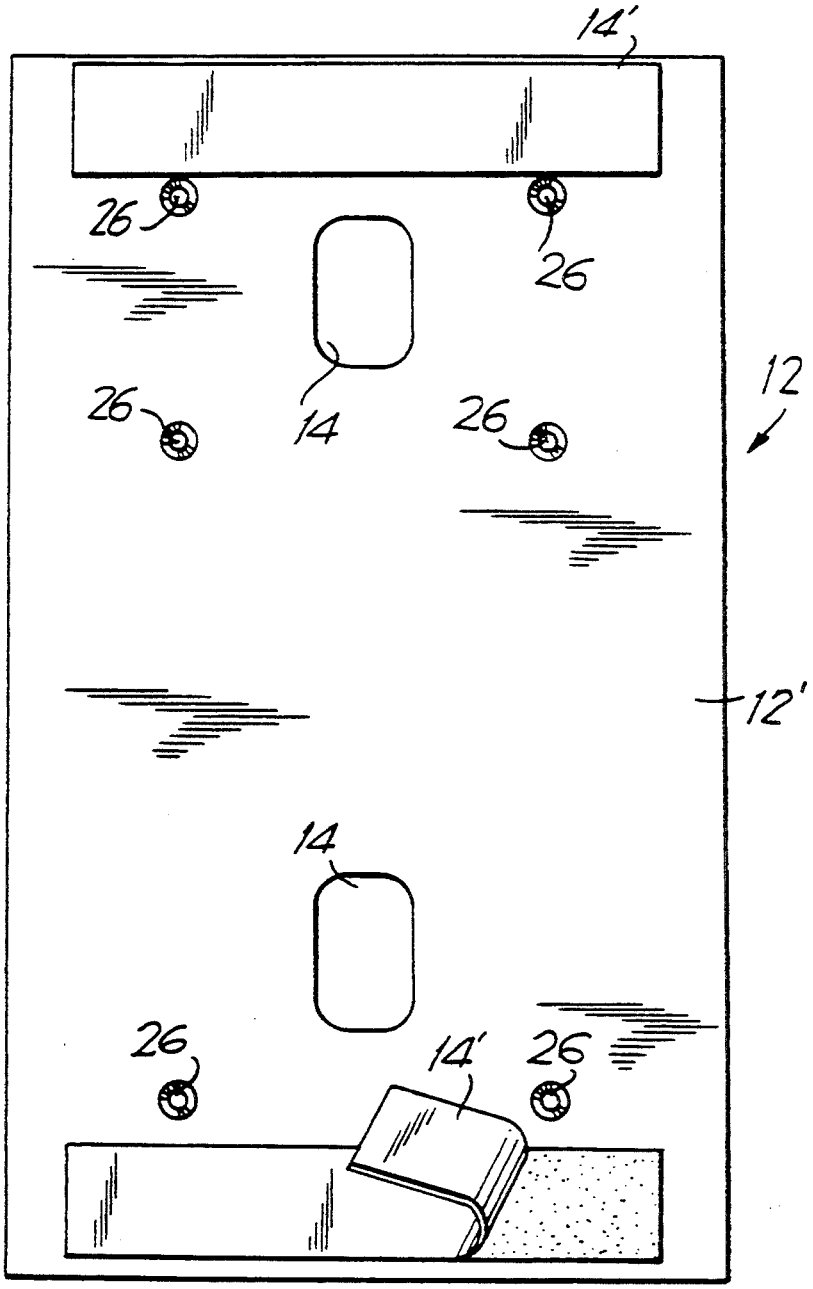
FIG. 9 is a view from outside of a cover of the inventive holding device.

Each elastic band 30 is formed as an endless band having two ends 31 and 32 which form loops and a main portion 22 extending between the ends 31 and 32. As can be seen from FIGS. 7 and 11, each elastic band is bent over the connecting member 23 of the insert 20, while the ends 31 and 32 of the elastic band are fitted with their loops on the pin 9 at two locations spaced from one another in a direction of the axis of the pin. The elastic bands elastically pull the connecting member 23 of the insert 20 toward the pins 9, and therefore elastically pull the insert 20 to the housing part 1, to hold the housing part 1 and the insert 20 in their proximal position shown in FIG. 1. In this position the container is held in the holding device. In order to exchange the container, the insert 20 is pulled upwardly by pulling its upper portion 21 upwardly away of the flange 4 of the housing part 1. The thusly released container is removed from the holding device and a new container is inserted in the device. Then the user releases the insert and the bans 30 pull the insert downwardly and clamp the new container in the holding device.

During movement of the insert part 20 relative to the housing part 1 between the distal and proximal positions, the projections 18 of the cover 12 are located at opposite sides of the elongated members 22 of the insert 20. Therefore, the elongated members 22 and the insert 20 as a whole are guided during movement between these positions.

Figure 3:
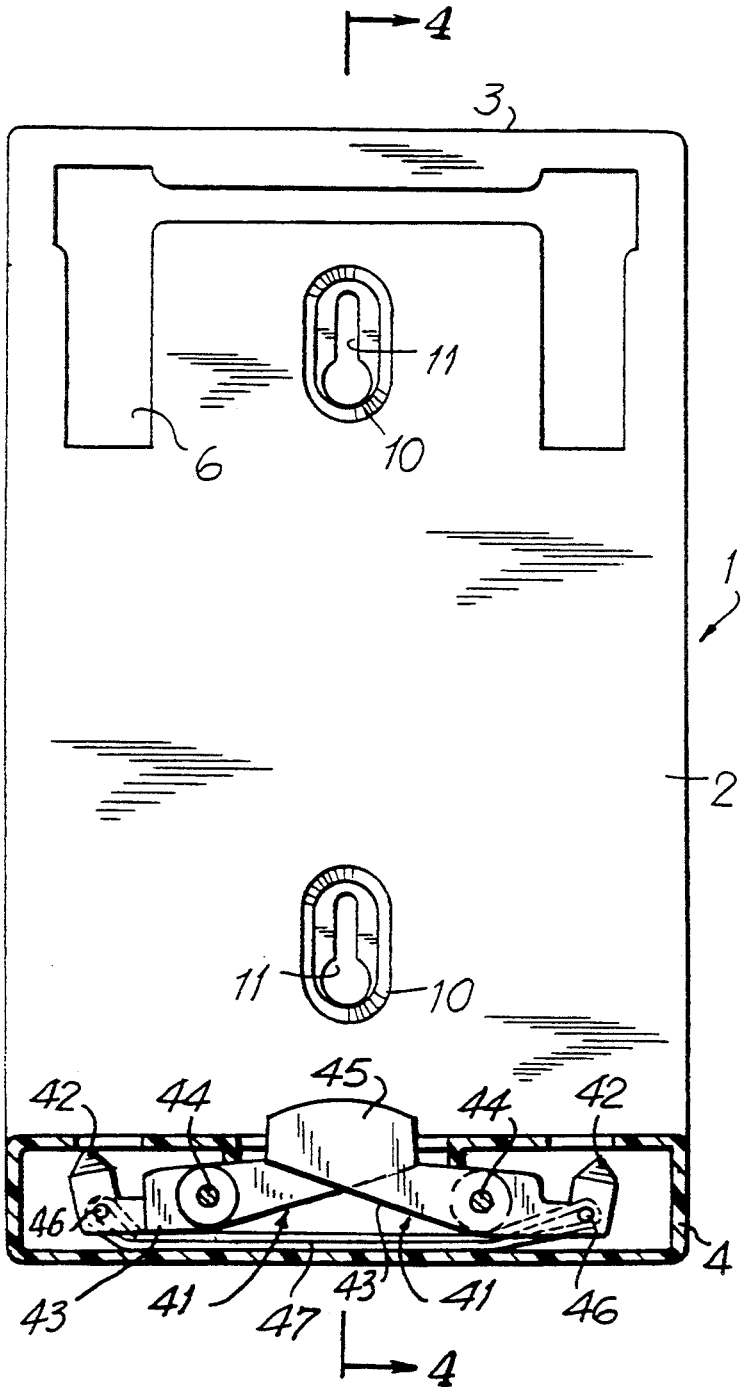
FIG. 3 is a front view with top portion removed.
Figure 4:
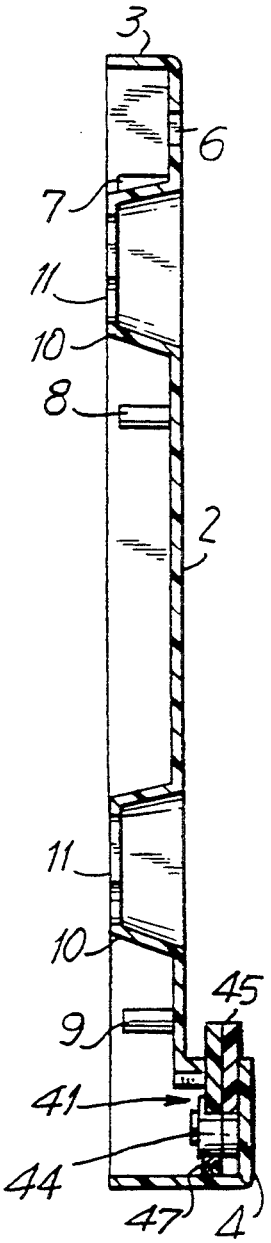
FIG. 4 is a section along line 4.4 of FIG. 3.

In order to insure a firm holding of the container in the holding device, the device is provided with engaging formations adapted to forcibly engage in the material of the container from the top and from the bottom. The engaging formation assemblies are shown in FIGS. 3 and 5. As can be seen in FIG. 3, the lower assembly includes two levers identified as a whole with reference numeral 41 and having main portions accommodated inside a hollow interior of the flange 4. Each lever 41 has an engaging projection formed as a tooth 42, a central part 43 mounted turnably on a housing pin 44, and an actuating projection 45. A holding pin 46 is provided on each arm in the region close to the engaging tooth 42, and an elastic element for example a rubber band 47 connects the holding pins 46 with one another with pretensioning. The upper wall of the flange 4 in FIG. 3 is provided with two openings for passing the engaging teeth 42 therethrough, and a central opening for passing the actuating projections 45 therethrough. A similar assembly is arranged in the hollow interior of the upper part 21 of the insert 2. It includes two levers 51 each having a projection formed as a tooth 52, a central part 53 turnably mounted on a housing pin 54 and an actuating projection 55.

Figure 2:
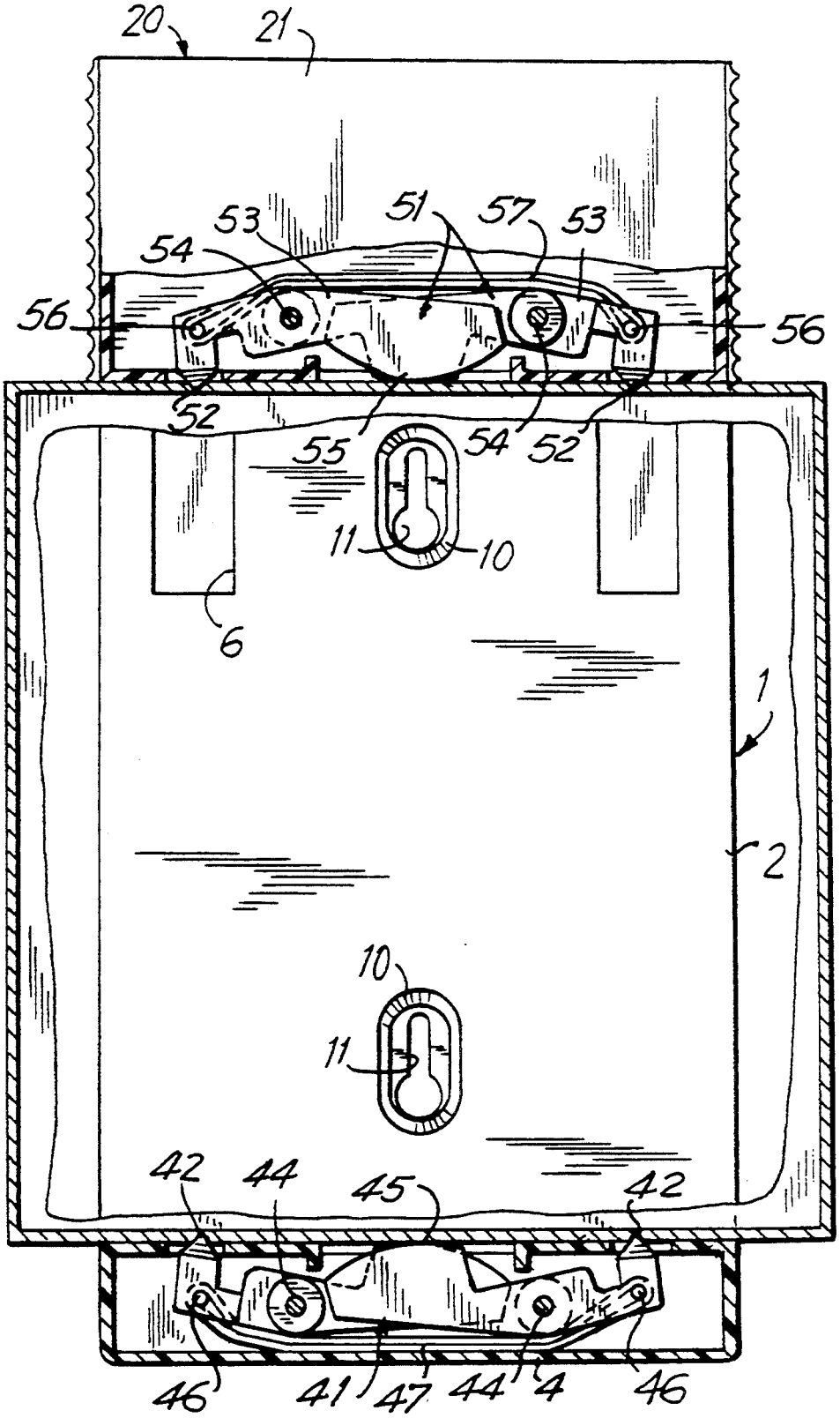
FIG. 2 is a view substantially corresponding to the view of FIG. 1 but showing the holding device with its parts in a distal position in which the parts are moved away from one another so that a new container can be inserted in the device.

As shown in FIGS. 1, 3 and 5, when no container is inserted in the holding device, the elastic elements 47 and 57 pull the levers 41 and 51 to a position in which only the actuating projections 45 and 55 extend outwardly beyond the flange 4 and the portion 21, while the engaging teeth 42 and 52 are hidden inside the flange 4 and the portion 21. When however a container is inserted in the device between the flange 4 and the portion 21, the container presses the actuating projections 45 and 55 into the interior of the flange 4 and the portion 21, under the action of the pressing force the arms 41 and 51 are turned, and the engaging teeth 42 and 52 pass through the corresponding openings in the flange 4 and in the portion 21 outwardly and forcibly engage into the lower and upper walls of the container so as to firmly hold the container in the device as shown in FIG. 2. When however the container is removed from the device, it no longer applies pressure to the actuating projections 45 and 55, and the elastic elements 47 and 57 turn the arms 41 and 51 to their position shown in FIGS. 3 and 5 so that the engaging teeth are retracted back into the interior of the flange 4 and the portion 21, while the actuating projections 45 and 55 again extend outwardly beyond the flange 4 and the portion 21. It is to be understood that the actuating projections do not have to be sharp or printed, and they are preferably rounded and do not pose any danger of injury to a user.

It will be understood that each of the elements described above, or two or more together, may also find a useful application in other types of constructions differing from the types described above.

While the invention has been illustrated and described as embodied in a holding device for containers with tissues and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A holding device for holding containers, comprising a housing; an insert movable relative to said housing between a proximal position in which the container can be clamped between said insert and said housing and a distal position in which said insert is moved away from said housing so that the container can be removed from the device and a new container can be placed between said insert and said housing; and means for engaging the container when the container is located between said insert and said housing so as to reliably hold the container in the device, said engaging means including at least one engaging projection which is elastically urged to a position in which said projection is hidden in one of said insert and said housing when there is no container between said insert and said housing and which is displaced outwardly of said at least one of said insert and said housing to an extended position when the container is inserted between said insert and said housing and applies a pressure to said engaging means.

2. A holding device as defined in claim 1; and further comprising elastic means for urging said engaging projection toward said hidden position.

3. A holding device as defined in claim 1, wherein said engaging means includes at least one further engaging projection, one of said engaging projections being arranged in said insert and another of said engaging projections is arranged in said housing, each of said engaging projections being movable between said hidden position and said extended position.

4. A holding device as defined in claim 3, wherein said engaging means includes two levers turnably mounted in said insert and said housing and each having one end provided with an engaging projection and another end provided with an actuating projection so that when the container is inserted between said insert and said housing the container applies a pressure to said actuating projection so as to turn said levers and move said engaging projection outwardly of said insert and said housing to said extended position to engage in the container.

5. A holding device as defined in claim 4, wherein said engaging means include two engaging projections provided in said insert and two engaging projections provided in said housing, each of said insert and said housing has two such levers; and further comprising means for elastically urging said engaging projections toward said extended position and including two elastic elements each elastically connecting two said levers of each of said insert and said housing with one another so as to urge said two levers toward one another and retain said engaging projections of said two levers in said hidden position.

6. A holding device as defined in claim 4, wherein said actuating projections are substantially rounded so as to prevent injuries to a user, while said engaging teeth are substantially sharp so as to engage in a wall of the container.

* * * * *